US009084492B2

(12) United States Patent
Guillory

(10) Patent No.: US 9,084,492 B2
(45) Date of Patent: Jul. 21, 2015

(54) PORTABLE KNEELING APPARATUS

(71) Applicant: Cynthia Guillory, Katy, TX (US)

(72) Inventor: Cynthia Guillory, Katy, TX (US)

( * ) Notice: Subject to any disclaimer, the term of this patent is extended or adjusted under 35 U.S.C. 154(b) by 42 days.

(21) Appl. No.: 13/918,830

(22) Filed: Jun. 14, 2013

(65) Prior Publication Data

US 2014/0368019 A1 Dec. 18, 2014

(51) Int. Cl.
*A47C 16/04* (2006.01)

(52) U.S. Cl.
CPC ..... *A47C 16/04* (2013.01)

(58) Field of Classification Search
CPC ..... A47C 9/027; A47C 16/04
USPC ..... 297/4, 187, 423.11, 423.41
See application file for complete search history.

(56) References Cited

U.S. PATENT DOCUMENTS

| | | | | | |
|---|---|---|---|---|---|
| 1,659,093 | A | * | 2/1928 | Gaskin | 297/377 |
| 1,660,494 | A | * | 2/1928 | Robertson | 297/377 |
| 2,101,259 | A | | 8/1936 | Landau | |
| D114,303 | S | * | 4/1939 | Sullivan et al. | D6/330 |
| 2,829,705 | A | * | 4/1958 | Godshalk et al. | 297/2 |
| 4,394,049 | A | * | 7/1983 | Ward | 297/423.11 |
| 4,491,193 | A | * | 1/1985 | Moss | 182/230 |
| D311,282 | S | * | 10/1990 | Tooley | D6/349 |
| 5,882,095 | A | | 3/1999 | Green | |
| 6,279,997 | B1 | | 8/2001 | Moore et al. | |
| 7,178,875 | B2 | * | 2/2007 | Laske, Jr. | 297/452.33 |
| D545,082 | S | | 6/2007 | Shaw | |
| D575,024 | S | | 8/2008 | Mays et al. | |
| D592,411 | S | * | 5/2009 | Moffat | D6/330 |
| 2004/0201268 | A1 | * | 10/2004 | Liao | 297/423.11 |
| 2004/0238699 | A1 | | 12/2004 | Harp | |
| 2007/0054595 | A1 | | 3/2007 | Pinto | |

* cited by examiner

*Primary Examiner* — Peter Brown
(74) *Attorney, Agent, or Firm* — The Keys Law Firm PLLC

(57) ABSTRACT

A portable kneeling apparatus for providing a selectively deployable fixed structure on which to kneel on comfortably. The portable kneeling apparatus comprises a rectangular body having a padded top surface and a solid bottom surface, two foldable fork legs disposed on opposing ends of the bottom surface of the rectangular body, and handle attached to one end of the top surface which turns both down and away from the portable kneeling apparatus. In this manner, the portable kneeling apparatus allows for the selective deployment of a padded surface secured to the ground by way of two fork legs which, when not deployed, is forms merely a substantially flat rectangular board structure which can be carried by most users with one arm.

3 Claims, 2 Drawing Sheets

PORTABLE KNEELING APPARATUS

BACKGROUND OF THE INVENTION

1. Field of the Invention

This invention relates generally to physical comfort devices and, more particularly, to a portable apparatus for providing physical comfort while kneeling.

2. Description of the Prior Art

An inevitable part of living is dealing with death. It is a well known and long standing practice of many to be buried in a cemetery after they die. One benefit of this ritual is that loved ones are able to visit the burial site and pray or meditate in remembrance of the deceased. As many burials sites are outdoors, however, it is unavoidable that visitation and other activities at a burial site are subject to and affected by the elements.

Consequently, a problem which exists, is that when a deceased's loved ones visit a burial site and kneel to pray and/or meditate, kneeling directly on the ground for any substantial period of time can cause substantial discomfort. In addition, such kneeling on the ground can often cause the kneeler to soil or otherwise dirty any clothing they may be wearing which covers their lower legs. Thus, there is a need for a portable apparatus which can be laid on the ground while a user seeks to kneel on the ground. It would be helpful for such an apparatus to have a self securing structure so as to not slide around on the ground while deployed or in use. It would be additionally desirable for such an apparatus be made of a material which provides cushion and comfort to the user as they kneel.

The Applicant's invention described herein provides for a portable kneeling apparatus which allows a user to deploy it on the ground to have a surface to kneel on. The primary components of Applicant's portable kneeling apparatus are a rectangular body, two foldable fork legs, and handle. When in operation, the portable kneeling apparatus allows a user to deploy a secured structure to the ground in order create a fixed structure to kneel on comfortably.

SUMMARY OF THE INVENTION

A portable kneeling apparatus for providing a selectively deployable fixed structure on which to kneel on comfortably. The portable kneeling apparatus comprises a rectangular body having a padded top surface and a solid bottom surface, two foldable fork legs disposed on opposing ends of the bottom surface of the rectangular body, and a handle attached to one end of the rectangular body which turns both down and away from the portable kneeling apparatus. In this manner, the portable kneeling apparatus allows for the selective deployment of a padded surface secured to the ground by way of two fork legs which, when not deployed, fold under the body to form a substantially flat rectangular board structure which can be carried by most users with one arm.

The portable kneeling apparatus is stored with its two fork legs folded under the bottom surface such that they each lay flat on the bottom surface. The portable kneeling apparatus is deployed by first folding each leg down so that it is oriented perpendicular to the bottom surface. Then the portable kneeling apparatus is placed with its bottom surface down on the surface sought to be kneeled on, with the fork legs piercing and entering the surface to secure the portable kneeling apparatus in place. When the user is finished, the handle is used for leverage to lift the fork legs out of the ground. The fork legs are then folded back into their storage position.

It is an object of this invention to provide a portable apparatus which can be laid on the ground while a user seeks to kneel on the ground.

It is another object of this invention to provide an apparatus which has a self securing structure so as to not slide around on the ground while deployed or in use.

It is yet another object of this invention to provide an apparatus made of a material which provides cushion and comfort to the user as they kneel.

These and other objects will be apparent to one of skill in the art.

DETAILED DESCRIPTION OF THE INVENTION

Figure 1:
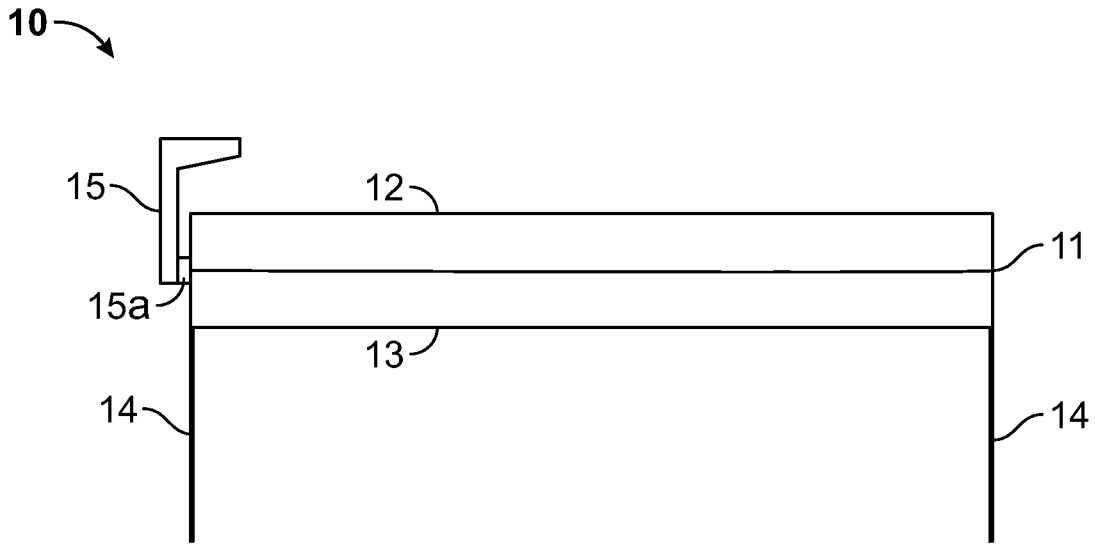
FIG. 1 is a front elevational view of a portable kneeling apparatus built in accordance with the preferred embodiment of the present invention with the handle in its upright position.

Referring now to the drawings and in particular FIGS. 1 2, 3, and 4, a portable kneeling apparatus 10 built in accordance with the present invention is shown comprising a rectangular body 11 having a padded top surface 12 and a solid bottom surface 13, two foldable fork legs 14 disposed on opposing ends of the bottom surface of the rectangular body 11, and a handle 15 attached to one end of the rectangular body 11. As the primary structure of the portable kneeling apparatus 10, the rectangular body 11 provides a body means for receiving a user's knees.

Figure 2:
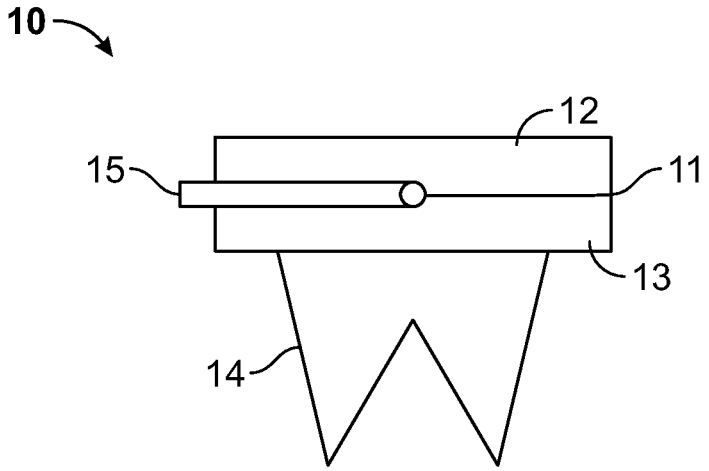
FIG. 2 is a side elevational view of a portable kneeling apparatus built in accordance with the preferred embodiment of the present invention with the handle in its down position.
Figure 3:
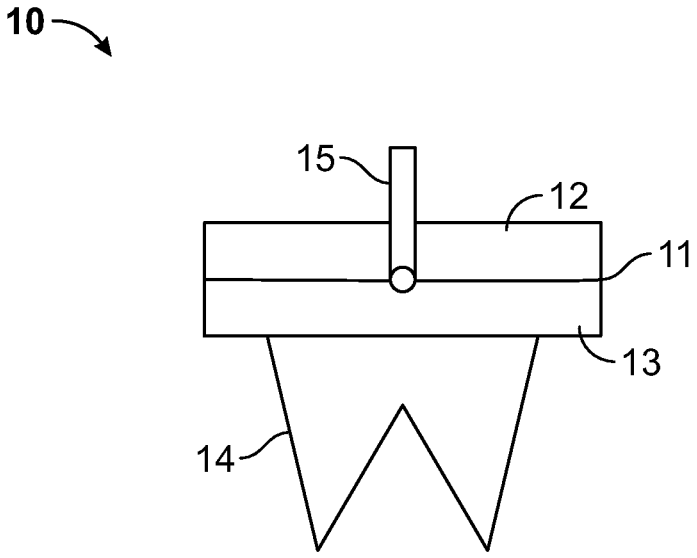
FIG. 3 is a side elevational view of a portable kneeling apparatus built in accordance with the preferred embodiment of the present invention with the handle in its upright position.

The portable kneeling apparatus 10 is shown in FIGS. 1, 2, and 3 in its deployed configuration, as the fork legs 14 are folded down in a perpendicular orientation relative to the bottom surface 13 of the rectangular body 11. In this configuration, the fork legs 14 can slide into the ground when the portable kneeling apparatus 10 is laid on the ground to be kneeled on. In this manner, each fork legs 14 provides a means for securing the body means to the ground.

Figure 4:
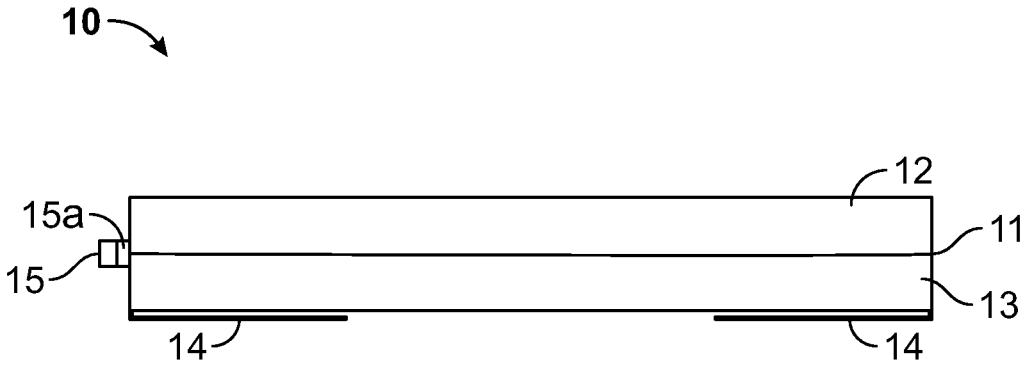
FIG. 4 is a front elevational view of a portable kneeling apparatus built in accordance with the preferred embodiment of the present invention with the handle in its down position.

In FIG. 4, the portable kneeling apparatus 10 is shown in its stored configuration. The fork legs 14 are folded in a parallel configuration respective to the bottom surface 13.

The handle 15 is configured to be placed in an upright position as well as to turn both down and away from the portable kneeling apparatus 10 in a receded position. The handle 15 is attached to the rectangular body 11 with a swivel joint 15*a* so as to allow for such rotation about the axis created by the handle's 15 connection to the rectangular body 11.

FIGS. 1 and 3 show the handle 15 in its upright position. When in its upright position, the handle 15 is used to dislodge a portable kneeling apparatus 10 which has been secured into the ground so that it can be lifted out of the ground so as to form a means for lifting the body means out of the ground.

FIGS. 2 and 4 show the handle 15 in its receded position, wherein it has been turned both down and away from the portable kneeling apparatus 10. Then in its receded position, the handle 15 is out of the way so as to not interfere with a kneeling user or a user carrying the portable kneeling apparatus 10.

It is contemplated that in some embodiments, the handle 15 will be configured to lock into its upright and receded positions, respectively, when placed in said positions by the user.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A portable kneeling apparatus comprising:

a rectangular body having a padded top surface on its top side and a solid bottom surface on the side opposite that of the padded top surface;

two fork legs disposed on said rectangular body on opposing ends of the bottom surface, each configured to be inserted into the ground when placed in a perpendicular orientation relative to the rectangular body through a plurality of tines;

a discrete handle attached to one side of the rectangular body, wherein the handle is attached to the rectangular body through a swivel joint such that it is configured to be selectably placed in at least two distinct positions and the handle is separate and distinct from the leg support and swivels about an axis that extends along a longitudinal dimension of the rectangular body; and wherein said fork legs are foldable such that can be selectively placed in a perpendicular orientation relative to the rectangular body or a parallel configuration against the bottom surface.

2. The portable kneeling apparatus of claim 1, wherein said rectangular body comprises a rigid rectangular profile.

3. The portable kneeling apparatus of claim 1, wherein the fork legs are each configured to be inserted into the ground when placed in a perpendicular orientation relative to the rectangular body through two tines.

* * * * *